US006386261B1

(12) United States Patent
Sieber et al.

(10) Patent No.: US 6,386,261 B1
(45) **Date of Patent: *May 14, 2002**

(54) DEVICE FOR APPLYING ADHESIVE MOUNTING TAPE

(75) Inventors: Reto Sieber, Sigigen; Marco Sieber, Rain, both of (CH)

(73) Assignee: Silu Verwaltung AG (CH)

( * ) Notice: Subject to any disclaimer, the term of this patent is extended or adjusted under 35 U.S.C. 154(b) by 0 days.

This patent is subject to a terminal disclaimer.

(21) Appl. No.: 09/441,414

(22) Filed: Nov. 16, 1999

Related U.S. Application Data

(63) Continuation of application No. 09/077,797, filed as application No. PCT/EP96/05620 on Dec. 13, 1996, now Pat. No. 6,029,729.

(30) Foreign Application Priority Data

Dec. 13, 1995 (DE) ..... 195 46 581

(51) Int. Cl.[7] ..... B65H 35/00
(52) U.S. Cl. ..... 156/577; 156/579
(58) Field of Search ..... 156/57, 579, 525, 156/527, 514

(56) References Cited

U.S. PATENT DOCUMENTS

| | | | | |
|---|---|---|---|---|
| 2,906,426 A | | 9/1959 | Fritzinger | 216/30 |
| 3,740,297 A | | 6/1973 | Vidinsky | 156/523 |
| 3,907,628 A | * | 9/1975 | Buske | 156/574 |
| RE30,787 E | * | 11/1981 | Pool et al. | 156/527 |

FOREIGN PATENT DOCUMENTS

| | | | |
|---|---|---|---|
| CL | 377 682 | 5/1964 | 70/18 |
| DE | 44 21 285 A1 | 6/1995 | B65H/37/00 |
| EP | 0 380 977 A1 | 8/1990 | B65H/35/07 |
| EP | 0 427 870 A1 | 5/1991 | B65H/35/07 |
| WO | WO 93 09050 | 5/1993 | B65H/35/00 |

* cited by examiner

*Primary Examiner*—Michael W. Ball
*Assistant Examiner*—Barbra J. Musser
(74) *Attorney, Agent, or Firm*—Fish & Richardson P.C.

(57) ABSTRACT

The invention provides a device for applying adhesive mounting tape from a roll on sections of walls, floors or ceilings, in particular on floor/wall finishing strips, for the purpose of attaching elements, which device has a handle and in the case of which there are provided, on a carrier, an application element for the mounting tape and a receiving element for the roll for unwinding the mounting tape, it being the case that the application element has, on at least one side, an application edge with such a radius that the adhesive mounting tape, which is fed without the free adhesive surface coming into contact with anything, can be fixed adhesively right into inner corners.

18 Claims, 2 Drawing Sheets

DEVICE FOR APPLYING ADHESIVE MOUNTING TAPE

This application is a continuation of U.S. application Ser. No. 09/077,797 filed Jun. 12, 1998, which is a 371 of PCT/EP96/05620 filed Dec. 13, 1996.

The invention relates to a device for applying adhesive mounting tape according to the preamble of claim 1.

Devices which can be used to apply adhesive tape from a roll onto a surface are known. The adhesive tape which is thus applied is used both for attaching certain elements, in particular skirting boards when carpeting is being laid, and for sticking together, for example, cardboard boxes. These known devices have a housing with a handle and an application roller, there being arranged in the housing an adhesive tape which is wound up on a roll and can be routed outwards, via the roll, through a slit arranged in the housing in the region of the roll and can be applied to the desired location. However, these devices are only suitable for thin adhesive tape which can be routed outwards in a narrow slit beside the roll and can be wound up on a roll with a relatively small diameter, in order that the size of the devices, which are designed as hand-held implements, remains manageable.

U.S. Pat. No. 4,707,202 describes a device for applying adhesive tape to wall sections from a roll. The device has two application rollers, of which one is approximately half the width of the adhesive tape and the second has an upside-down V-shaped profile, in order to press the adhesive tape into a corner. By virtue of the V-shaped profile roller, the adhesive tape is given a right-angled form and, in this form, is adhesively bonded, in the corner region, to two surfaces adjacent to the corner.

CH 377 682 describes a hand-held implement for applying a self-adhesive tape over an edge. The hand-held implement has a pressure-exerting lever and a contact lever, which project out of a base plate of the implement and each bear a running roller. The adhesive tape is drawn off from an adhesive-tape supply roll and is pressed on by means of a roller. The implement serves for packaging purposes and, accordingly, is suitable for outer edges.

GB 2 274 448 A describes a device for dispensing and applying an adhesive tape. The device has a base plate which is guided on wheels, on which an adhesive-tape supply roll is arranged and from which the adhesive tape is unwound. The device has adjustable rollers in order to fold, and smooth, the unwound tape at a top edge, the device being provided for applying adhesive tape to a smooth surface.

DE 37 36 376 C1 likewise describes a hand-held implement for transferring, in particular, an adhesive film from a backing film onto a surface. The adhesive film is fed, from a supply reel, to an application element, which projects from the hand-held implement and is intended for pressing the adhesive side against the surface, the adhesive tape being designed such that the adhesive remains on the surface and the adhesive-bearing substrate is guided back onto a winding-up reel of the hand-held implement again. The substrate with the adhesive film runs over a projecting application strip which, although, in principle, permitting an adhesive strip to be adhesively bonded in an inner corner, is unsuitable, without interrupting the application operation, for fixing adhesive tape securely and reliably on outer corners and positioning the adhesive tape round the latter.

EP 0 380 977 A1 likewise describes a hand-held implement for transferring a film from a backing film onto a substrate. The adhesive-bearing film is unwound from a supply reel and fed, via an application element, to a winding-up reel. The application element projects out of the housing and is designed as a constituent part of a triangular region, triangularly tapering transverse walls being integrally formed on for this purpose. The triangular region is fixedly connected to the housing of the hand-held implement. Although the triangular form makes it possible for adhesive strips to be applied in an inner corner, the continuous application of adhesive strips round an outer corner is only possible to a limited extent.

Also known, for the purpose of fastening, in particular, floor/wall finishing strips when carpeting is being laid, are skirting-board systems which are attached to the corresponding walls in the conventional manner by nailing or drilling, pinning and subsequent fixing by screws. As skirting-board systems, use is preferably made of core-type skirting boards. These core-type skirting boards serve as carriers for, for example, textile floor coverings. Since there are often irregularities on those regions of the walls which are arranged in the vicinity of the floor, it is necessary for such skirting boards to be fixed firmly on the wall, in order that subsequent detachment of the skirting boards as a result of irregularities of this type can be avoided. For this reason, an adhesive tape which is adhesive on both sides and has a certain minimum thickness, in order, on the one hand, to be able to compensate at least partially for the irregularities in said wall regions and, on the other hand, to have sufficient strength to allow the core-type skirting boards to be retained on the wall sections, has been developed. This adhesive tape is used, for example, in buildings made of prefabricated concrete elements.

The conventional method which has been used up until now for applying such an adhesive tape has been a manual one. For manual application of such an adhesive tape, that side which is not coated with a protective layer is applied to the wall and pressed on by hand. The manual pressing-on operation, however, cannot ensure that the adhesive tape adheres equally well to all locations on the wall. Secondly, manual application requires a relatively large amount of physical exertion in terms of the relatively large number of metres which are necessary for laying such skirting-board systems. Once the adhesive tape has been pressed on, the protective layer or cover layer can be drawn off, with the result that the second adhesive layer is exposed and the corresponding skirting-board system can be press-fixed on the wall.

A further disadvantage with manual application of the adhesive mounting tape is that the accuracy by which the distance of the top edge of the adhesive mounting tape from the floor can be maintained is restricted and, as a result, it may be necessary, once the respective skirting board has been attached, to do follow-up work in order to remove the protruding adhesive tape.

Also known are systems in which the skirting boards are coated with cartridge adhesive or the adhesive is applied in the wall region and the skirting boards are then pressed onto the wall. Systems of this type too are relatively time-consuming and do not ensure sufficient accuracy, upon application of the adhesive tape, in terms of uniform application and, as a result, achieving a high adhesive force and in terms of maintaining the distance of the top edge of the adhesive tape from the floor region or a corresponding reference edge.

The object of the present invention is thus to provide a device which is intended for feeding double-sided adhesive mounting tape to, in particular, flat sections, which, even in the case of inner and outer corners in the wall region, does not necessitate an interruption in the continuous application process of the adhesive mounting tape, and by means of which it is possible to achieve a high application rate for the adhesive mounting tape along with improved adhesive behaviour and reduced physical exertion.

This object is achieved by a device with the features according to claim 1.

Expedient developments are defined in the dependent claims.

According to the invention, the device for applying adhesive mounting tape, in particular double-sided adhesive mounting tape, which is preferably wound up on a roll and serves for attaching elements to sections of walls, floors or ceilings and, in particular, to floor/wall finishing strips, has a handle or grip by means of which the device can be guided in those locations of the respective wall regions which are predetermined for the application of the adhesive mounting tape. According to the invention, the device has an application element for the adhesive mounting tape and a receiving element for the adhesive mounting tape, which is wound up on the roll, this adhesive mounting tape being unwound from said receiving element. The application element and the receiving element are each arranged on a carrier, it being the case that the application element has, on at least one side, such a radius that the adhesive mounting tape, which is fed without its free adhesive surface coming into contact with anything, can be fixed adhesively right into inner corners without the movement of the device having to be stopped. This means that the radius on one side of the application means must not be larger than the radius which is generally provided in inner corners and is defined by the casting or installation of the concrete elements. Furthermore, the radius must not be so small that the adhesive mounting tape, when applied, is damaged by the application means or remains stuck to the relatively sharp edge which is then present, as a result of which the operation of applying the adhesive tape will be rendered more difficult overall.

According to a preferred exemplary embodiment, the application element is mounted rotatably. This means that the adhesive tape, on the one hand, can more easily be fixed adhesively right into the inner corners and, on the other hand, it can likewise more easily be positioned round the outer corners without there being any need for interrupting the continuous application process, i.e. continuous movement of the device according to the invention in the direction of adhesive-tape application.

In yet another exemplary embodiment of the invention, the application element is defined as a turnaround element and has at least two application edges and application surfaces. A turnaround element in this context is intended to mean an element which, after having passed a corner, to be precise either an inner corner or an outer corner, turns around, in order that the adhesive tape can be applied continuously, without warping, to the surface which follows the respective corner. In the process, the adhesive tape runs over the application edges, which, according to the invention, have such a radius that, in the case of inner corners, the application edges extend right into these corners, and the application surfaces are provided so that, after having passed a corner, the application element rests relatively uniformly and flush against the wall which is to be provided with the adhesive tape. In this case, the adhesive tape is guided between wall and application surfaces. On the side which is directed towards the wall, the adhesive tape has a free adhesive layer and, on the side which is directed towards the device, the adhesive tape is also provided with a non-stick tape, in particular a paper tape. It is this paper tape which runs over the turnaround element or the application edges and application surfaces of the same, which makes it possible to avoid the situation where the adhesive tape sticks to the respective elements of the device according to the invention.

According to yet another exemplary embodiment, the application element is designed in the form of a spatula and is fixedly installed on the carrier of the device according to the invention. The spatula-like element has the advantage that it is good for introducing the adhesive tape into inner corners, but has the disadvantage that, in the case of irregularities in the region in which the adhesive tape is to be applied, the relatively non-elastic spatula edge is not capable, in particular when it comes into contact with protrusions, of pressing the adhesive tape uniformly onto the uneven wall sections. Furthermore, a fixed application element such as a spatula of this type has the disadvantage that, in the corners, the device has to be moved over a relatively large distance in order to pass, from the wall in front of the corner to the wall after the corner, into the respective adhesive-tape-application position, which to a certain extent makes it more difficult to apply adhesive tape continuously. For this reason a preferred exemplary embodiment provides the device, as has already been explained, with a rotatably mounted application element.

In order to be able to reduce the turnaround distance of the turnaround element, and thus the necessary movement of the device according to the invention when it goes around corners, to be precise both inner corners and outer corners, yet another preferred exemplary embodiment provides the turnaround element with a triangular form, in which case the turnaround element then has, in the region of each corner of the triangle, an application edge with such a radius that said edge can apply the adhesive mounting tape in inner corners. Moreover, in the region between the application edges, the turnaround element has in each case essentially planar application surfaces, which are interrupted by a curved recess. The curved recess between the application surfaces, arranged beside the application edges, is used for turning the turnaround element, as the latter goes round outer corners, and thus reducing the pivoting or pivoting movement of the device according to the invention as the adhesive mounting tape is applied. However, it is also possible for the application element to have four, five or more sides, provided that it is ensured that the angle which is formed in the region of an application edge between the application surfaces, which are each located adjacent to the application edge, is smaller than the angle which is formed at inner corners of the wall sections to which the adhesive tape is to be applied.

According to yet another preferred exemplary embodiment, at least one pressure-exerting roller is provided on the carrier, which bears the application element and the receiving element and on which the handle for guiding the device according to the invention is fixed. In this case, the at least one pressure-exerting roller is arranged on the device according to the invention such that, in the direction in which the adhesive tape is applied to the respective wall section, it follows the application element and has the task of pressing the adhesive tape as uniformly as possible onto the wall section. If the adhesive mounting tape is pressed on uniformly, this means that the strength and behaviour of the adhesive of the adhesive mounting tape are at an optimum. The at least one pressure-exerting roller is preferably of elastic design, in order to be able to compensate for bumps and irregularities and, thus, to be able to press on the adhesive tape equally well in the regions beside such bumps and protrusions.

In order for the implement to be provided in a manageable form, the carrier is designed as a base plate, in which case the receiving element for the roll of adhesive mounting tape, the application element and the pressure-exerting roller as well as the handle are fixed to it. The base plate is preferably designed such that the roll for the adhesive mounting tape is arranged relatively centrally and the pressure-exerting roller or rollers and the application element are arranged in outer regions.

According to yet another preferred exemplary embodiment, the handle is designed as a respectively laterally supported carrier without the lateral supports being connected to one another by a base plate. The handle has, on its angled, lateral supports, fastening devices for the application element and the pressure-exerting roller and, moreover, receives the carrier for the adhesive mounting tape and the receiving element for the roll of adhesive mounting tape, the carrier bearing the receiving element. The carrier preferably has a cylindrical core, onto which the roll of adhesive mounting tape is pushed. For a better sliding action, the laterally angled supports of the handle, which, along with the handle, constitute the actual carrier, are Teflon-coated.

The receiving element for the roll can preferably be adjusted in height for the purpose of adapting the application height of the adhesive mounting tape. The receiving element is preferably arranged in the hollow core which receives the roll of adhesive mounting tape. In this case, the carrier is preferably attached to the height-adjustable receiving element, so as to accommodate, during height adjustment, the roll with the adhesive mounting tape, said roll rotating on the carrier as the adhesive mounting tape is unwound.

According to a further preferred exemplary embodiment, the height-adjustable receiving element is arranged in the interior of the hollow cylinder part for receiving the adhesive mounting tape. In this case, the receiving element is designed as a sleeve which, on a bar element arranged in its interior; can be displaced between a first stop and a second stop. The first stop corresponds to the lowermost position for the application height of the adhesive mounting tape, and the second stop corresponds to the highest position for the application height of the adhesive mounting tape. Between these two positions, the sleeve can be displaced on the bar element with sliding action.

The sliding displacement of the sleeve on the bar element is preferably produced by means of a threaded element which is arranged in the interior of the sleeve and interacts with the bar element. The threaded element is preferably adjusted by means of a screw-action grip arranged in the handle. By means of straightforward adjustment of the screw-action grip, it is thus also possible, in the operating position of the device for applying adhesive mounting tape, to adjust the application height of the mounting tape and thus to adapt the application height to a wide range of conditions.

According to yet another preferred exemplary embodiment, the receiving element for the roll of adhesive mounting tape has a guide, which is attached to the carrier and is intended for the roll core, on which the adhesive tape is wound up, and a pressing-down means, which is arranged opposite said guide. The guide for the roll core ensures that the adhesive tape, when unwound, rotates about a fixed axis of rotation. The pressing-down means has the task of ensuring that the roll always remains on the guide for the roll core and that there is thus no change in the height of the adhesive tape in relation to the surface on which the device according to the invention is guided during application of the adhesive mounting tape.

In order to be able to ensure easy exchange or replacement of the rolls of adhesive mounting tape, the pressing-down means is of releasable design and can be fixed between a roll-retaining position, in which it presses the roll onto the guide, and a roll-removing/roll-loading position, in which a roll can be removed from the guide, and thus from the inventive device as a whole, and a new, full roll can be introduced into the guide.

In yet another exemplary embodiment according to the invention, the pressing-down means is preferably designed as a spindle disc and is provided with a spring, with the result that the pressing-down means can engage at least partially in the roll core and thus ensures reliable guidance of the rotation of the roll of adhesive tape as it is unwound about a fixed axis. The pressing-down means is preferably provided with an arresting means, which is arranged in the handle of the device and is intended for retaining the spindle disc in the roll-removing/roll-loading position.

Spacers are preferably provided on the underside of the carrier for the purpose of setting the desired application height of the adhesive mounting tape, it preferably being possible for said spacers to be adjusted. The spacers are preferably produced from a material which allows them to slide easily over the underlying surface on which the device for applying the adhesive mounting tape is guided.

It is preferable for both the spacers and the application element to be produced from a plastic.

The minimum size of the device according to the invention is determined by the size of the diameter of the roll of adhesive mounting tape. Since the adhesive mounting tape, for fastening, for example, core-type skirting boards, has a relatively thick adhesive layer, yet another exemplary embodiment of the invention provides for the carrier to be of such a size that the distance between the application element and the axis of rotation of the roll makes it possible to receive rolls with a diameter of greater than 14 cm. Depending on the size of the device according to the invention, it is, of course, also possible even for considerably larger rolls to be used; the disadvantage of considerably larger rolls of adhesive mounting tape, however, is that the manageability of the device as a whole is then restricted. In principle, however, the device can also be used for adhesive rolls with a smaller diameter, although in this case it is then necessary for a new, full roll of adhesive mounting tape to be introduced into the device more frequently.

In order that the adhesive which is present on the side surfaces of a roll of adhesive mounting tape does not stick to the carrier, yet another preferred exemplary embodiment provides for the coating of the carrier to be of a non-stick design. "Non-stick" should be taken as meaning, for the carrier and the plate-like element, that there is no adhesive adhering, but the plate-like element nevertheless adheres slightly to the adhesive roll. There is preferably located, between the carrier and that side surface of the roll of wound-up mounting tape which is directed towards the carrier, a flat plate-like element, which preferably adheres slightly to the roll of adhesive mounting tape and also rotates, during unwinding of the mounting tape, but does not adhere to that surface of the carrier which is directed towards the roll. This flat plate-like element is preferably a non-stick paper. The non-stick property may be achieved, for example, by a paper impregnated with a silicone. However, it is also possible for the flat plate-like element to be a Teflon-coated metal disc.

The device according to the invention may also be coupled to another device, which serves the purpose, once the adhesive mounting tape has been applied, of detaching the protective cover strip from the actual adhesive layer. It is also possible for the device to be provided with a long handle, such that the task of applying adhesive tape in the floor/wall region can also be carried out from an upright position.

It is also possible for the device to be operated in an automated manner, i.e. to be provided with its own drive. This allows the device to be advanced automatically.

Further advantages, features and possible applications of the present invention will now be explained in detail, by way of exemplary embodiments, with reference to the attached drawings, in which.

Figure 1:
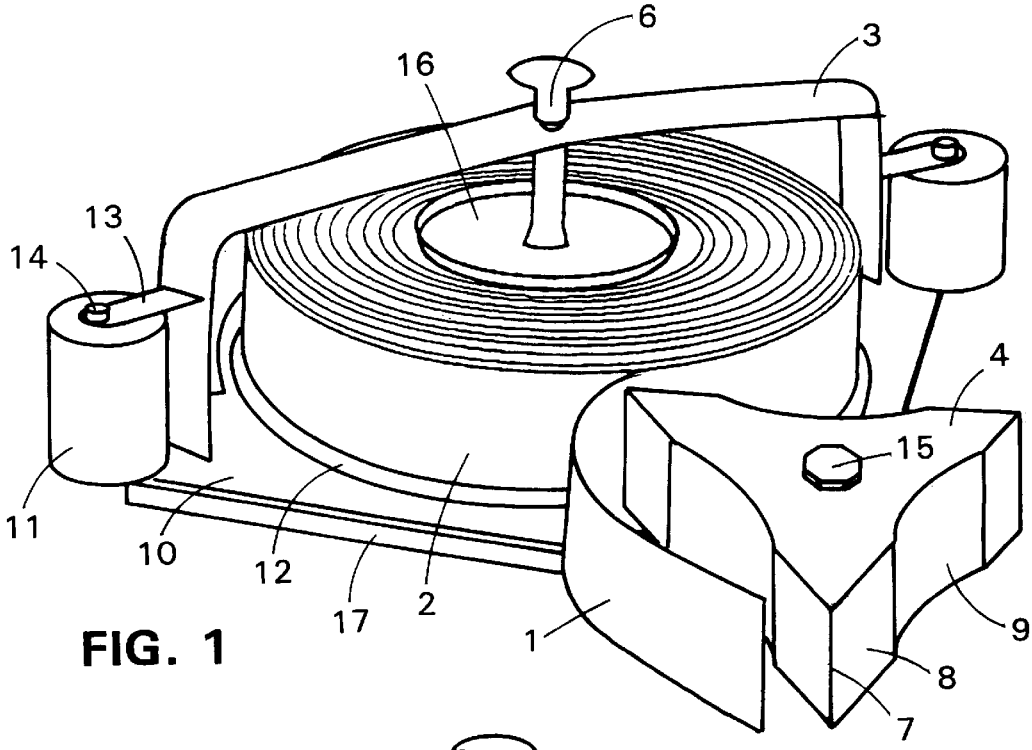
FIG. 1 shows a perspective view of a device according to the invention with a roll of adhesive mounting tape introduced.

FIG. 1 illustrates one exemplary embodiment of the device according to the invention. The device has had an adhesive mounting tape 1 in the form of a roll 2 introduced into it. The roll 2 of adhesive mounting tape 1 is spanned by a handle 3, the handle being angled at its opposite ends and being welded to a base plate 10. The height may differ depending on the tape width. Arranged to the side of the handle 3, at one corner of the base plate 10, is an application element 4, which is designed as a turnaround element. The application element may differ depending on the tape width. The application element 4 is mounted rotatably by means of a stay bolt 15, which is fastened to the bass plate 10. The application element 4 is of, in principle, triangular form in plan view, thus forming three application edges 7, from which in each case two application surfaces 8 extend to each side. A curved recess 9 is located between the application surfaces 8 assigned to each application edge 7. Upon application of the adhesive mounting tape 1, of which the adhesive side is oriented away from the application element 4, a non-adhesive and non-stick layer being directed towards the application element 4 and being detachable from the actual adhesive layer once the adhesive mounting tape has been applied to the respective wall section, the application surfaces 8 press the adhesive tape onto an essentially planar wall section until, for example, an outer corner runs into the recess 9 by virtue of the device as a whole being moved forwards. When the outer corner has moved slightly beyond the centre of the curved recess 9, the rotatable mounting of the application element 4 causes the latter to swing round, with the result that the application surfaces 8 of the next side of the. application element 4, which constitutes a triangle in principle, come to rest against the desired wall section.

When, following a planar or straight wall section, the device comes into the vicinity of an inner corner, the application edge 7 pushes the adhesive tape so that the adhesive side, which is directed towards the wall, is fixed adhesively right into the inner corner, it being the case that after this, as the device continues to move, the latter pivots slightly and the turnaround element swings round in order to press the adhesive tape on that wall section which follows immediately after the inner corner.

A pressing-down means 6 presses the roll 2 of adhesive mounting tape 1 into a guide 5 (not illustrated in FIG. 1) about which the roll 2 is guided as the adhesive tape is unwound, or applied, therefrom. On its top side, i.e. the surface which is directed towards the roll 2, the carrier 10 has a non-stick layer. Furthermore, a paper disc is provided on that side of the roll 2 of adhesive mounting tape 1 which is directed towards the carrier 10, said paper disc, on the one hand, adhering to the roll 2 and, on the other hand, being coated, on the side which is directed towards the surface of the carrier 10, with a non-stick layer with good sliding properties. When the adhesive mounting tape 1 is applied to a corresponding wall section, the roll 2 is rotated and thus slides on the surface of the carrier 10. The pressing-down means 6 is designed with a spindle disc 16, which at least partially engages in the core of the roll 2 of adhesive mounting tape and thus ensures centering of the roll 2. The pressing-down means 6 can be combined with an arresting means in the handle 3, with the result that, when the pressing-down means 6, and thus the spindle disc 16, are raised, a spring provided being compressed by the pressing-down means 6 being raised, [lacuna] can be introduced into the arresting means, so that the pressing-down means with the spindle disc 16 can be secured in a raised position. As a result, the roll 2 can be removed from the guide 5 and replaced by a new, full roll.

Provided on each of the angled regions of the handle 3 is a carrying arm 13, which fixes the top end of an axial pin 14 which is connected to the carrier 10. The axial pin 14 serves as a bearing for a pressure-exerting roller 11. The outer circumference of the pressure-exerting roller 11 extends beyond the outer edge of the carrier 10, the pressure-exerting roller 11 being produced from an elastic polymer material. As the adhesive tape 1 is guided, and pressed, against the respective wall section, then, depending on the direction in which the device according to the invention is guided along the wall section, one of the pressure-exerting rollers 11 follows the application element 4, thus ensuring that the strip of adhesive mounting tape 1, applied to the wall section by means of the application element 4, is pressed on. The elasticity of the pressure-exerting roller 11 also means that the adhesive strip is pressed securely and reliably on wall regions which are somewhat irregular or which exhibit bumps and other kinds of irregularity. This ensures that the adhesive strip comes into contact with the respective wall section over its entire side which is directed towards the wall, and high adhesive strength of the adhesive strip is thus realized. Depending on the tape width, it is possible for the pressure-exerting roller to be higher, or it is possible for two or more rollers to be arranged one above the other.

Figure 2:
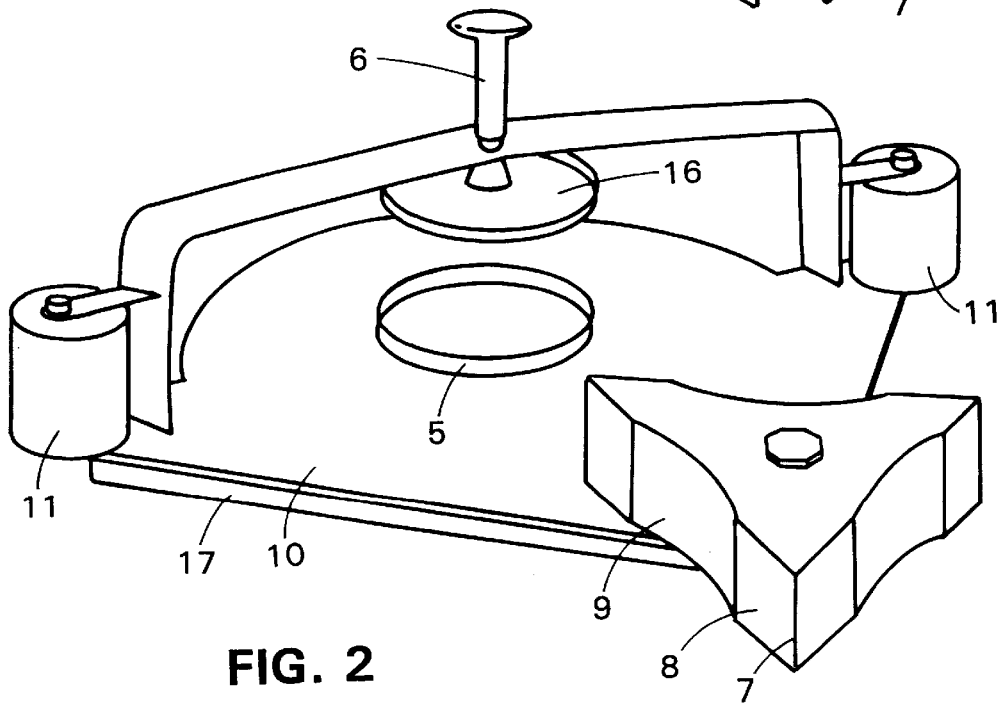
FIG. 2 shows the device according to FIG. 1 with the roll of adhesive mounting tape removed, the pressing-down means being retained in the roll-removing/roll-loading position.

FIG. 2 shows how the pressing-down means 6 in the arresting means in the handle 3 is secured in the raised position, which corresponds to the roll-removing/roll-loading position. In this position, the roll 2 of adhesive mounting tape 1 or, once the mounting tape wound up thereon has been used up, the roll core can be raised out of the guide 5 and removed from the device and, finally, replaced by a new, full roll 2. After a new, full roll 2 has been positioned on the guide 5, which is designed as a collar around an opening in the carrier 10, the pressing-down means 6 is released from the arresting position, as a result of which the spindle disc 16 can partially engage in the roll core and thus centres the latter and retains it axially. The adhesive mounting tape 1 is then drawn off from the end of the roll and applied to the application element 4 by means of its non-stick paper layer and applied to the wall section by way of the adhesive side, which is directed towards the wall section. The device can then be guided along the wall section. The actions of the adhesive tape being guided and simultaneously pressed on by the elastic pressure-exerting rollers 11, as well as the action of the application element swinging round or moving round the respective inner corners or outer corners, ensure a relatively high rate of application of the adhesive mounting tape. Fixed to the underside of the carrier 10 are spacers (not illustrated), by means of which the application height of the adhesive mounting tape 1 can be defined.

Application elements of different sizes are expediently provided for the device described, with the result that the device can also be used for applications in which the distances between inner corners and outer corners are relatively small. In this case, the extent of the application element between two adjacent application edges 7 has to be selected so as to be slightly smaller than the distance between adjacent inner and outer corners.

Depending on which adhesive-tape width is used, the elements such as application element 4 and pressure-exerting roller 11 can be fixed exchangeably to the carrier, in order for it to be possible to use elements which correspond to the width of the mounting tape 1 and thus to ensure flexible use of the device as a whole. The distance between the handle 3 and the carrier 10 may be larger in accordance with the width of the pressure-exerting roller(s).

Figure 3:
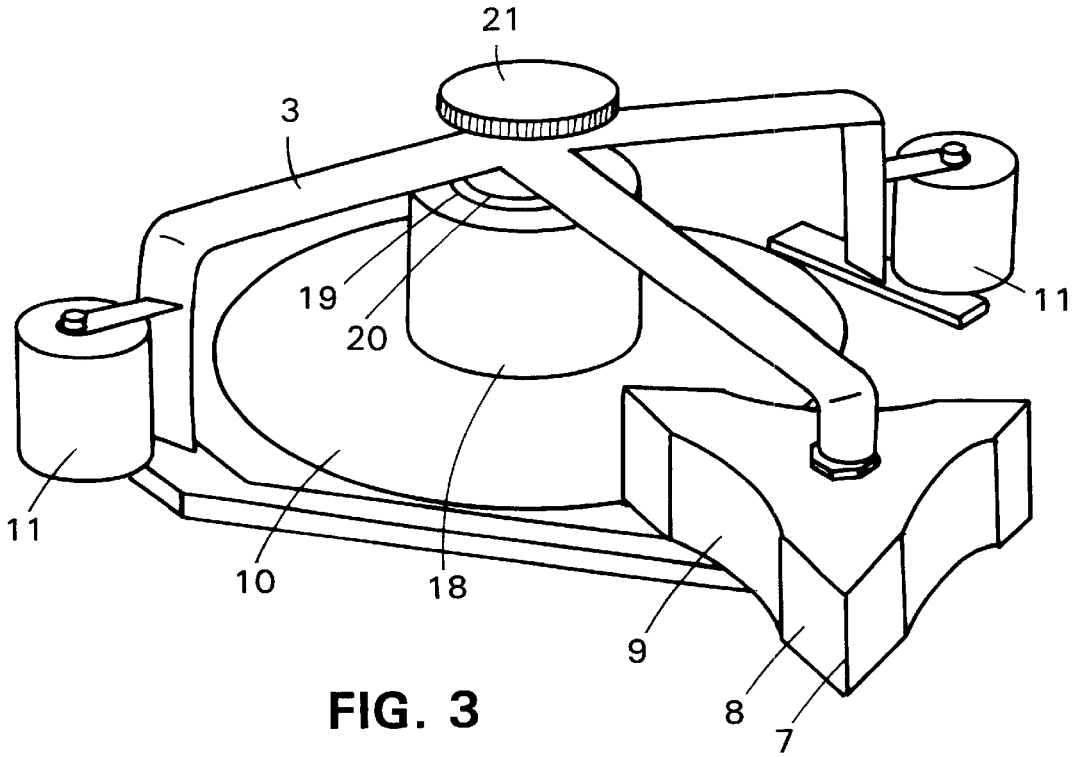
FIG. 3 shows a further exemplary embodiment of the device according to the invention.

FIG. 3 illustrates a further exemplary embodiment of the device according to the invention. In the exemplary embodiment illustrated, the receiving element is designed as a height-adjustable receiving element 18, the receiving element 18 comprising a cylinder core, which receives the roll of adhesive mounting tape, and a sleeve 19, which is arranged in the interior of said cylinder core and is provided on a bar element 20 so as to be displaceable with sliding action. The bar element 20 is fixedly connected to the handle 3, on its side which is directed towards the latter, and extends into the sleeve 19. At its end which is located opposite the handle 3, and is situated in the sleeve 19, the bar element 20 interacts with a threaded element (not illustrated) which can be adjusted by means of a screw-action grip 21 on the top side of the handle 3. Arranged releasably on the underside of the sleeve, which is likewise connected to the threaded element, is the carrier 10 for the adhesive mounting tape, the carrier being of plate-like design and, once attached to the sleeve 19, bearing the adhesive tape 1. By virtue of the screw-action grip 21 being turned, it is thus possible to displace the sleeve in the longitudinal direction with respect to the bar element, in order to be able to adjust the height of the receiving element. The height-adjustable receiving element thus means that the application height of the adhesive mounting tape can be varied. Provided in the wall of the sleeve is a slot (not illustrated.) in which a pin, which is connected to the bar element 20, can be moved in the manner of stops when the receiving element is adjusted in height between a top position for the application height of the mounting tape and a bottom position for the application height of the mounting tape.

What is claimed is:

1. Device for applying adhesive mounting tape from a roll on sections of walls, floors or ceilings, in particular on floor/wall finishing strips, it being the case that the device has a handle, a rotatably mounted application element for the adhesive mounting tape, and a receiving element for the roll for unwinding the mounting tape, these being arranged on a carrier, and it being the case that the application element has, on at least one side, an application edge with such a radius that the mounting tape, which is fed with the free adhesive surface oriented away from the application element, can be fixed adhesively right into inner corners, characterized in that, in plan view, the application element has a form which is provided with at least two application edges perpendicularly with respect to the application direction, it being the case that arranged beside the application edges are planar application surfaces, for the purpose of applying the mounting tape to essentially planar surfaces, and provided between the application surfaces which are arranged between two adjacent application edges is in each case one recess, in the form of a curved section, for the purpose of pivoting the application element when it goes round outer corners.

2. Device according to claim 1, characterized in that at least one pressure-exerting roller is provided on the carrier.

3. Device according to claim 2, characterized in that the pressure-exerting roller is formed from an elastic material.

4. Device according to claim 2 or 3, characterized in that the handle is designed as a laterally supported carrier which bears the application element, the pressure-exerting roller, the carrier and the receiving element for the roll of adhesive mounting tape.

5. Device according to claim 2 or 3, characterized in that the carrier is designed as a base plate and bears the receiving element for the roll of adhesive mounting tape, the application element, the pressure-exerting roller and the handle.

6. Device according to claim 2 or 3, characterized in that the receiving element for the roll of mounting tape has a guide, which is attached to the carrier and is intended for the roll core, and a pressing-down means, which is arranged opposite said guide.

7. Device according to claim 6, characterized in that the pressing-down means is releasable and can be fixed between a roll-retaining position and a roll-removing/roll-loading position.

8. Device according to claim 7, characterized in that there are provided a spindle disc, for the at least partially spring-loaded engagement of the pressing-down means in the roll core, and an arresting means, which is arranged in the handle, and is intended for retaining the spindle disc in the roll-removing/roll-loading position.

9. Device according to one of claims 1 to 3, characterized in that a spacer is provided on the carrier for the purpose of setting the application height of the mounting tape.

10. Device according to claim 1, characterized in that the receiving element for the roll can be adjusted in height for the purpose of adapting the application height of the adhesive mounting tape.

11. Device according to claim 10, characterized in that the carrier is attached to the height-adjustable receiving element.

12. Device according to claim 10 or 11, characterized in that the height-adjustable receiving element is designed as a sleeve which, on a bar element arranged in its interior, can be displaced with sliding action between a first stop, which corresponds to the lowermost position for the application height of the adhesive mounting tape, and a second stop, which corresponds to the highest position for the application height of the adhesive mounting tape.

13. Device according to claim 12, characterized in that the displacement can be produced by means of a threaded element which is arranged in the interior of the sleeve and interacts with the bar element.

14. Device according to claim 13, characterized in that the threaded element can be adjusted by means of a screw-action grip arranged in the handle.

15. Device according to claim 1, characterized in that the application element consists of plastic.

16. Device according to claim 1, characterized in that the carrier is of such a size that the distance is between the application element and the axis of rotation of the roll makes it possible to receive rolls with a diameter of greater than 14 cm.

17. Device according to claim 1, characterized in that provided between the roll of mounting tape and the carrier is a flat plate-like element which rotates along with the roll during unwinding of the mounting tape, the flat plate-like element being a paper element which has non-stick properties on the side directed towards the surface of the carrier and of the mounting tape.

18. Device according to claim 17, characterized in that the flat plate-like element is a metal disc which is Teflon-coated on its side directed towards the surface of the carrier and of the mounting tape.

* * * * *